US006481026B1

(12) United States Patent
McIntosh

(10) Patent No.: US 6,481,026 B1
(45) Date of Patent: Nov. 19, 2002

(54) ATHLETE'S NECK AND SPINE SAFETY BRACE

(76) Inventor: Thomas John McIntosh, 2555 Ridgeway Dr., Kissimmee, FL (US) 34746

( * ) Notice: Subject to any disclaimer, the term of this patent is extended or adjusted under 35 U.S.C. 154(b) by 0 days.

(21) Appl. No.: 10/035,409

(22) Filed: Jan. 3, 2002

(51) Int. Cl.[7] ..... A41D 13/00
(52) U.S. Cl. ..... 2/468; 2/416; 602/18
(58) Field of Search ..... 2/468, 455, 425, 2/44, 45, 459–461, 415–416; 128/97.1, DIG. 23, DIG. 19; 602/5, 17, 18, 19, 20; 244/122 AG; 280/290

(56) References Cited

U.S. PATENT DOCUMENTS 3,134,106 A * 5/1964 Shaffer et al. ..... 2/425
3,497,872 A * 3/1970 Mitchell ..... 2/468
3,671,974 A * 6/1972 Sims ..... 2/421
3,818,509 A * 6/1974 Romo et al. ..... 2/421
3,900,896 A 8/1975 Ackerman
4,338,685 A 7/1982 LaPorta, Jr.
5,123,408 A 6/1992 Gaines
5,371,905 A * 12/1994 Keim ..... 2/413
5,437,613 A * 8/1995 Reggio et al. ..... 2/425
5,546,601 A 8/1996 Abeyta
6,006,368 A 12/1999 Phillips

* cited by examiner

*Primary Examiner*—Gloria M. Hale
*Assistant Examiner*—Tejash Patel
(74) *Attorney, Agent, or Firm*—Harpman & Harpman

(57) ABSTRACT

A neck and spine brace device for athletes that allows for a free and natural range of head motion while providing a stabilization link between a helmet and force absorbing body protection. The interlinking brace yields under torsional and multi-load flexation while compression of the helmet loads are transferred under longitudinal force dispersion to shoulder protection pads of the user.

19 Claims, 5 Drawing Sheets

ATHLETE'S NECK AND SPINE SAFETY BRACE

BACKGROUND OF THE INVENTION

1. Technical Field

This device relates to helmets, shoulder pads and neck braces that are used in sports to protect the player from injury inducing impacts.

2. Description of Prior Art

A variety of prior art safety devices are commonly used for football players that include helmets and body pads. While helmets reduce the direct impact to the player's head, a great deal of attention has been directed to preventing neck and spinal injuries. Typically, such devices include neck pads or cervical collars that stabilize the head and neck from force inducted movement. Many of the injuries involve compression fractures to the cervical region of the spine when the head is forced downwardly during impact.

Prior art devices that have addressed this issue can be seen, for example, in U.S. Pat. Nos. 3,900,896, 4,338,685, 5,123,408, 5,546,601 and 6,006,368.

In U.S. Pat. No. 3,900,896 a neck brace can be seen having a rigid fixation bar that is secured to the back of the helmet with a pivot pin extending therefrom which is registerable into a socket secured on the shoulder pads of the player.

In U.S. Pat. No. 4,338,685 a cervical collar is illustrated that attaches to the shoulder pad harness to reduce the neck opening and impede helmet movement and thus reduce injuries thereto.

U.S. Pat. No. 5,123,408 is directed to a sports helmet brace that provides for a compound bar element movably secured to the outer bracket secured to the top of a sports helmet and then extends to a shoulder engagement harness.

In U.S. Pat. No. 5,546,601 a neck and cervical spine protector device is claimed having a helmet base engagement upper portion and depending shoulder pad engagement legs extending therefrom.

A combined helmet and shoulder pad is disclosed in U.S. Pat. No. 6,006,368 wherein a rigid rod extends between an attachment brace on the helmet to a mounting bracket secured to the shoulder pads.

SUMMARY OF THE INVENTION

The present invention relates to a sports helmet impact stabilization device that provides a flexible force transfer brace capable of selective fluctuation during use. The device of the invention is secured between the base of the sports helmet and preferably the upper edge portion of the shoulder pad and alternately to the backside of the shoulder pad typically used in the football game environment. A compound pad is formed of foam and plastic in parallel adjoining segments that impart flexibility and load impact resistance along its longitudinal axis. The stabilization device is removably secured to the helmet and the shoulder pads for effective force transfer.

DESCRIPTION OF THE PREFERRED EMBODIMENT

Figure 1:
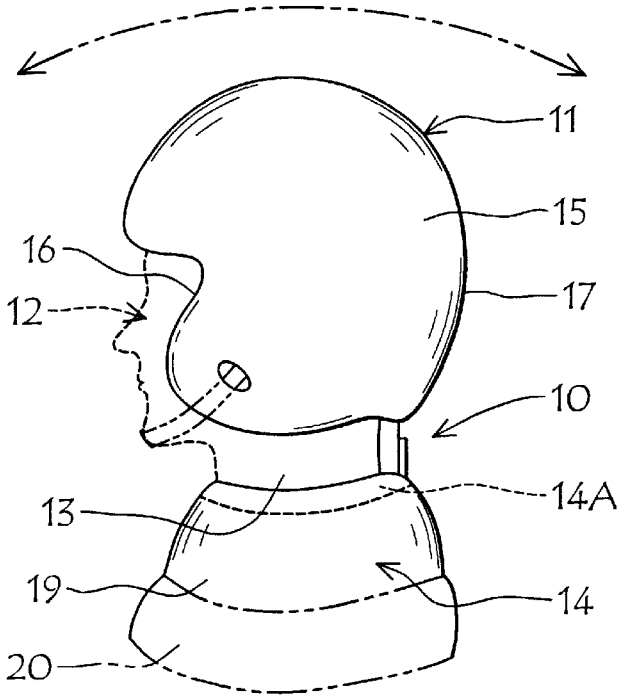
FIG. 1 is a partial side elevational view of a sports helmet on a player with the safety brace of the invention positioned thereon illustrating front to back range of motion of the helmet by the broken line arrow.
Figure 2:
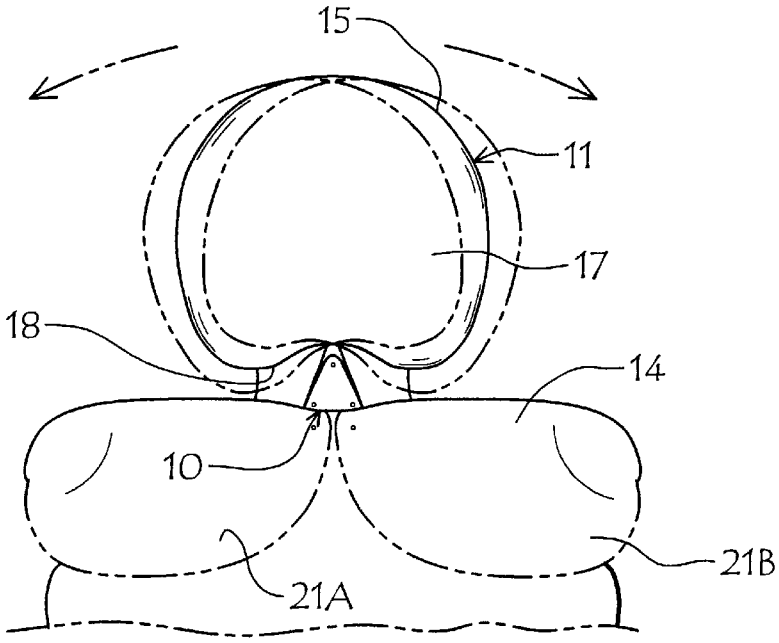
FIG. 2 is a rear elevational view showing the safety brace attached to the helmet and shoulder pads illustrating a side-to-side range of motion of the helmet in broken lines.
Figure 3:
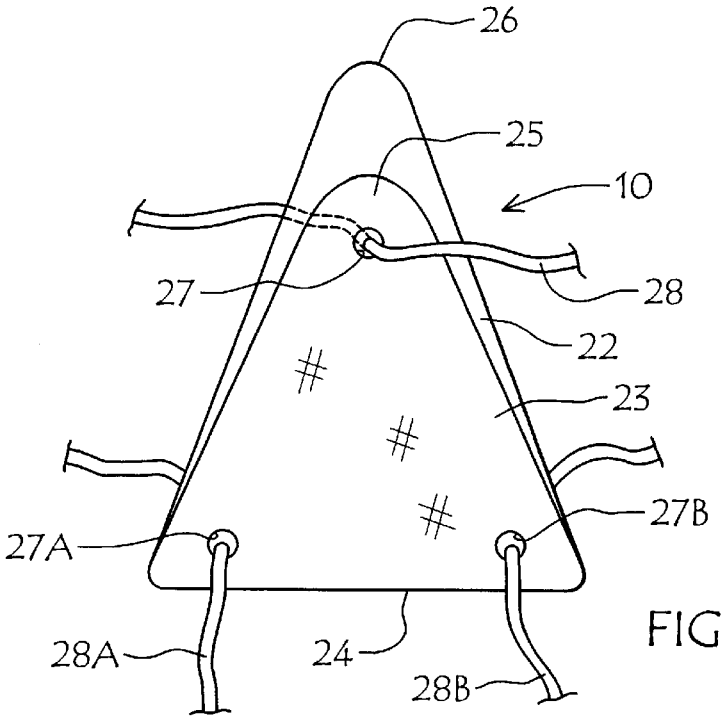
FIG. 3 is a rear elevational view of the safety brace of the invention.
Figure 4:
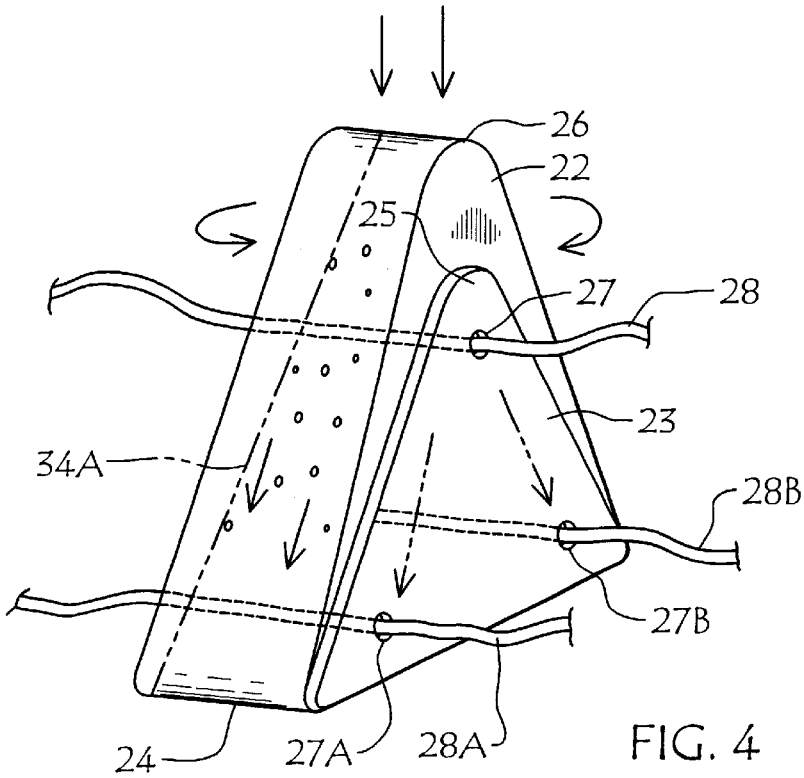
FIG. 4 is a perspective view of the safety brace of the invention.
Figure 6:
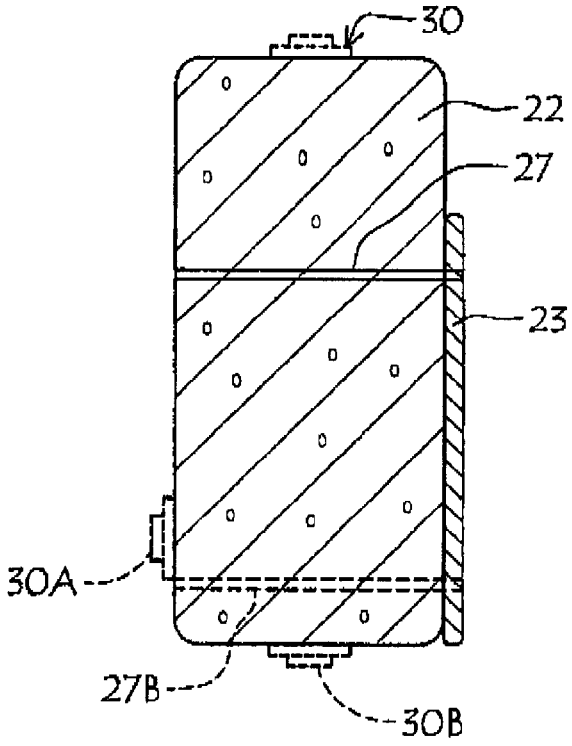
FIG. 6 is a cross-sectional view of the safety brace.
Figure 5:
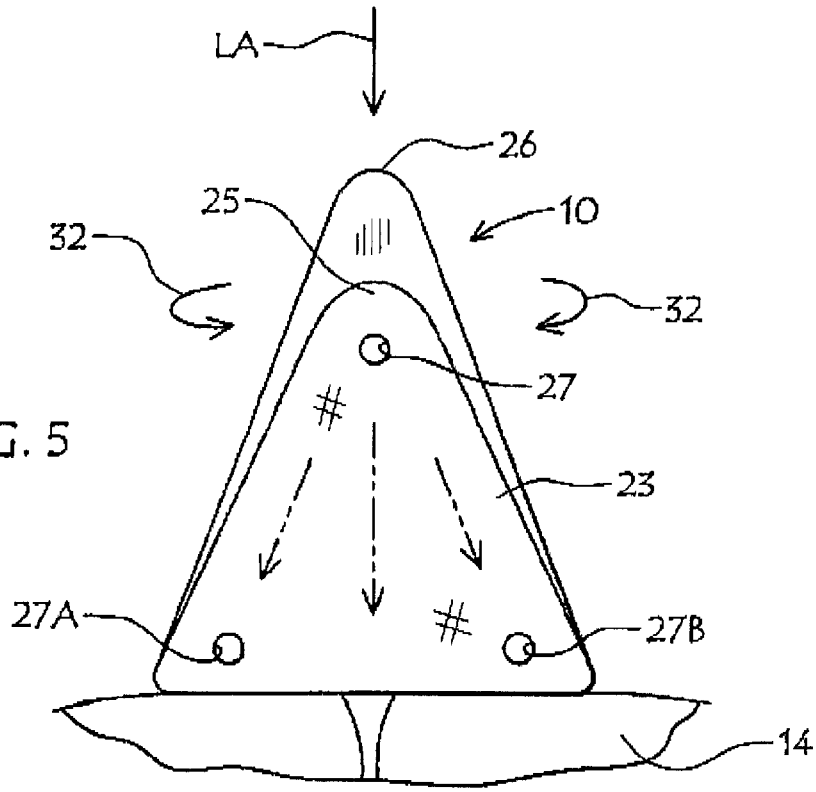
FIG. 5 is a rear elevational view of the safety brace.

Referring to FIGS. 1–6 and 8 of the drawings, a neck brace 10 can be seen for use with a sports helmet 11 used by a player 12 shown in dotted lines in FIGS. 1 and 2. The sports helmet 11 is specifically used in football wherein the user's neck 13 can be subject to high impact forces during play. Players typically wear safety equipment on their body that helps protect them such as shoulder pads 14. The football helmet 11 has a hard outer shell surface 15 and a foam liner 15A with a front opening 16, a back portion 17 and neck opening generally indicated at 18. The shoulder pads 14 are illustrated in FIGS. 1 and 2 of the drawings in a general manner having a shoulder overlapping portions 19 and 20, interconnecting back portions 21A and 21B and a foam neck pad 14A. The neck brace 10 of the invention has a compound structure having a triangular shaped synthetic resin foam portion 22 with an attached support plate 23 as best seen in FIGS. 3–6 of the drawings. The support plate 23 extends from a base portion 24 and tapers upwardly to a conversion point at 25 in spaced relation to a terminal top portion 26 of the triangular foam portion 22. The support plate 23 is of a generally thin flat configuration made preferably of rigid synthetic resin material. Both the plate 23 and foam 22 have aligned apertures at 27, 27A and 27B therethrough to afford transverse positioning of respective mounting tie cords 28, 29A and 29B that extend therethrough. The cord 28 is used to interconnect the neck brace 10 with the lower engaged portion of the helmet 11. Conversely, the respective cords 29A and 29B extend through registering openings O in the shoulder pads 14 as best seen in FIG. 2 of the drawings. Alternately, a swivel snap fastener assembly 30 shown in broken lines in FIGS. 6 and 7 of the drawings can be secured to the foam portion 22 at its convergent point 26 and correspondingly to the lower surface of a foam liner 31 in the helmet 11. Additional snap fastener assemblies can alternated be positioned at 30A, 30B and 30C as shown. FIG. 4 of the drawings also illustrates a tapered foam surface 34A defined by broken lines will be described in detail hereinafter as an alternate form of the invention.

It will be evident from the above description that the neck brace 10 will allow for unrestricted movement of the helmet 11 in side-to-side, front to back and up and down motions. Additionally, rotational movement of the helmet 11 will be unrestricted by the attachment of the neck brace 10 given the range of motion attachment assembly and the limited torsional rotation of the foam portion 22 that extends beyond the support plate 23 illustrated by rotational arrows 32 in FIG. 5 of the drawings.

In use, when the neck brace 10 sustains impact on its longitudinal axis LA, as indicated, the support plate 23 will be engaged and act to transfer and dissipate the impact load to the shoulder pads 14.

Figure 7:
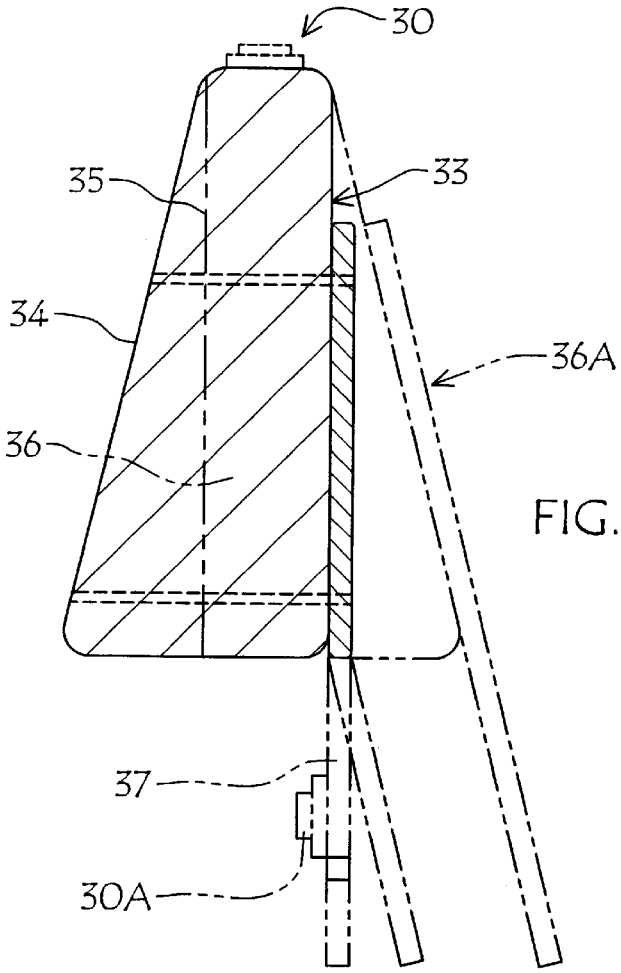
FIG. 7 is a cross-sectional view of alternate forms of the safety brace showing respectively in broken, solid lines and dotted lines.
Figure 8:
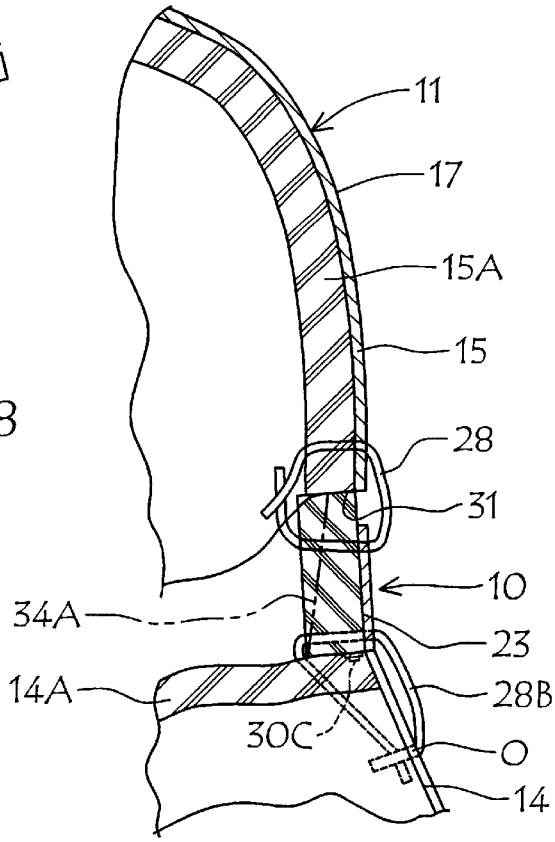
FIG. 8 is a partial cross-sectional view of a football helmet and shoulder pad configuration with the safety brace of the invention positioned thereon.
Figure 9:
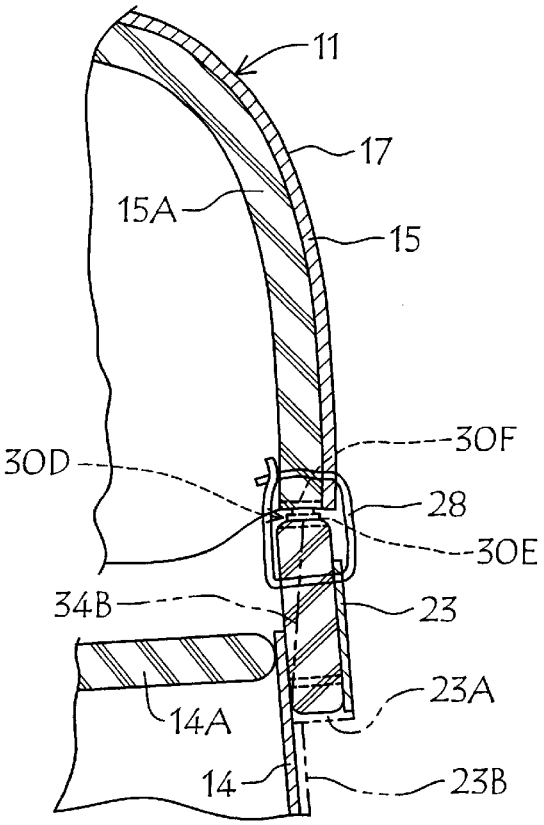
FIG. 9 is a partial cross-sectional view of the football helmet and shoulder pads with an alternate positioning of alternate safety braces.
Figure 10:
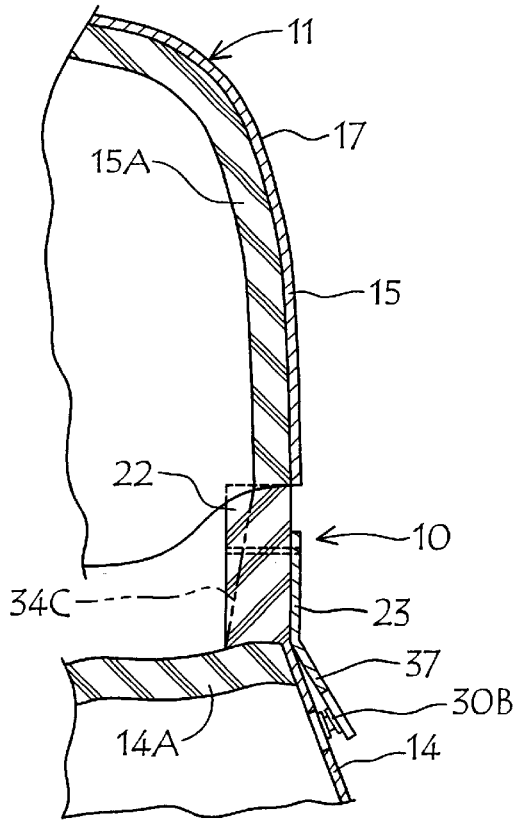
FIG. 10 is a partial cross-sectional view of the football helmet and shoulder pad with an alternate form of the safety brace positioned thereon.

Referring now to FIGS. 7 and 10 of the drawings, alternate forms of the invention can be seen. In FIG. 7 a modified neck brace 33 has a tapered surface 34 of a foam portion 35, also in FIGS. 4 and 8–10 broken lines define tapered surfaces 34A, 34B and 34C.

A second alternate form of the invention can be seen and illustrated by broken lines through the foam portion 35 imparting an area of reduced dimension at 36. A third alternate form of the invention is illustrated in broken lines at 36A wherein tapered surface 36B with related support plate 37A is defined with the hereinbefore described broken line 35. All of the hereinbefore described forms of the invention may be modified by the extension of the support plate 23 beyond the base portion 24 as seen in broken lines in FIG. 7 and in solid lines in FIG. 10 of the drawings at 37.

Referring now to FIG. 9 of the drawings, alternate forms of the invention are illustrated as alternate support plate 23A has a return right angular extension 38 for added support by engagement with the shoulder pads 14. A second alternate support plate 23B has a secondary return right angular extension 39 from said extension 38 as noted for additional support and alternate mounting forms. The mounting position is illustrated for the neck brace 10 in which the brace 10 is connected to the helmet and then positioned on the outside surface of the shoulder pads 14 by contoured deflection thereon. The brace 10 is secured to the helmet in this example by an alternate attachment fastener in the form of a fastener assembly 30D having a male portion 30E on the foam portion 22 and a female 30F on the helmet 11. The shoulder pads 14 are secured to the brace in the normal manner as hereinbefore described or alternately by use.

It will be apparent that other connecting construction may be used between the brace 10 and the helmet 11 that will allow a significant range of motion therebetween without departing from the spirit of the invention as set forth hereabove.

It will thus be seen that a new and useful safety neck and spine brace has been illustrated and described and that it will be apparent to those skilled in the art that various changes and modifications may be made thereto without departing from the spirit of the invention.

Therefore I claim:

1. A neck and spine brace for use with a sports helmet and sport shoulder pads comprising, a contoured body member of synthetic resin foam material, said body member having a helmet engagement portion and a shoulder pad engagement portion, a support plate secured in abutting continuous contact over said support plates entire engagement surface to said contoured foam portion, means for removably securing said brace to said respective helmet and shoulder pads, said support plate extending uniformly from a base portion of said foam portion to a termination point in spaced relation to a termination point of said respective foam portion in spaced relation to said base portion of said foam portion.

2. The neck and spine brace set forth in claim 1 wherein said contoured body member has oppositely disposed tapered sides.

3. The neck and spine brace set forth in claim 1 wherein said support plate is of a flat configuration.

4. The neck and spine brace set forth in claim 1 wherein said support plate is preferably made of synthetic resin material.

5. The neck and spine brace set forth in claim 1 wherein said means for removably securing said brace to said respective helmet and shoulder pads comprises, a plurality of cord ties extending through aligned apertures in said contoured foam body member and said support plate respectively.

6. The neck and spine brace set forth in claim 1 wherein said means for removably securing said brace to said contoured foam portion further comprises, a range of motion assembly extended between said brace and said helmet.

7. The neck and spine base set forth in claim 6 wherein said range of motion assembly extending between said brace and said helmet comprises, a swivel snap fastener on said termination point of said foam portion in spaced relation to said support plate.

8. The neck and spine brace set forth in claim 1 wherein said helmet engagement portion of said foam body member is of a known transverse dimension and said shoulder pad engagement portion is of a transverse dimension less than that of said helmet engagement portion.

9. The neck and spine brace set forth in claim 1 wherein said contoured body member of synthetic foam material is of a triangular shape.

10. The neck and spine brace set forth in claim 1 wherein said helmet engagement portion extends beyond said support plate.

11. The neck and spine brace set forth in claim 10 wherein said contoured body member of synthetic foam material has oppositely disposed tapered sides defining a triangular configuration.

12. A neck and spine brace for use with a sports helmet and sport shoulder pads comprising, a contoured foam body member of a synthetic resin foam material, said body member has a helmet engagement portion and a shoulder pad engagement portion, a support plate secured to said body member, said support plate extending beyond said shoulder pad engagement portion, means for removably securing said brace to said respective helmet and shoulder pad.

13. The neck and spine brace set forth in claim 12 wherein said support plate is of a cross-sectionally flat triangular configuration.

14. The neck and spine brace set forth in claim 12 wherein said support plate is preferably made of rigid synthetic resin material.

15. The neck and spine brace set forth in claim 12 wherein said means for removably securing said brace to respective helmet and said shoulder pads comprises, a plurality of tie cords extending through aligned apertures in said contoured foam body member and said support plate.

16. The neck and spine brace set forth in claim 12 wherein said helmet engagement portion is secured to said helmet by an interconnecting swivel fastener.

17. The neck and spine brace set forth in claim 12 wherein said support plate extends over said base portion of said foam body member.

18. The neck and spine brace set forth in claim 17 wherein said support plate extends beyond said base exterior portion in spaced parallel relation to said support plate portion adjacent said contoured foam portion.

19. The neck and spine brace set forth in claim 17 wherein said support plate extending beyond said base exterior portion is removably secured to said shoulder pads by an interconnecting snap fastener.

* * * * *